United States Patent [19]

O'Brien

[11] Patent Number: 4,921,453

[45] Date of Patent: May 1, 1990

[54] MOLDED COMPLAINT SPRINGS

[75] Inventor: John F. O'Brien, Downingtontown, Pa.

[73] Assignee: ICI Americas Inc., Wilmington, Del.

[21] Appl. No.: 336,950

[22] Filed: Apr. 13, 1989

[51] Int. Cl.[5] ..... H01R 11/00

[52] U.S. Cl. ..... 439/630; 439/86; 439/886

[58] Field of Search ..... 439/886, 887, 86, 90, 439/629–637

[56] References Cited

U.S. PATENT DOCUMENTS 2,765,450 10/1956 Richardson ..... 439/633
3,404,370 10/1968 Bryner et al. .
4,220,386 9/1980 Kenny ..... 439/86
4,440,463 4/1984 Gliha et al. .
4,462,657 7/1984 Snowdon et al. .
4,544,227 10/1985 Hirose .
4,604,678 8/1986 Hagner .
4,607,907 8/1986 Bogursky .

*Primary Examiner*—Joseph H. McGlynn

[57] ABSTRACT

This invention relates to an electrical connector receptacle for connecting separable conductive members where the receiving connector receptacle has at least one compliant spring member of molded thermoplastic therein and in close spatial proximity to each compliant spring member is molded a rigid protective housing-barrier which limits the deflection of the compliant spring when a mating conductive member is inserted.

13 Claims, 2 Drawing Sheets

MOLDED COMPLAINT SPRINGS

The present invention relates to electrical connectors, and more particularly, to a connector for attachment directly to a printed circuit board wherein the connector is molded as an integral part of the circuit board.

BACKGROUND OF THE INVENTION

At present, in electrical packaging of printed circuit boards, the Input/Output connectors are separate devices from the printed circuit board if they are the compliant portion of the electrical connection. At times, the edge of a printed circuit board, the tongue, is a portion of the electrical connection—but it is non-compliant. That is, it does not adjust for variations in the mechanical interface. This task is the responsibility of the compliant member of the electrical connection. All electrical connectors which are designed for multiple connections and disconnections must have at least one compliant member. The compliant member, often a metal spring, is necessary to create and maintain a certain amount of interfacial pressure, or normal force, between itself and the other member to which it connects. This normal force must be maintained under varying conditions of manufacturing tolerances, assembly tolerances, expansion and contraction due to temperature changes and physical disturbances such as shock and vibration. The other member may or may not be compliant.

The compliant member is usually made of conductive material, such as a copper alloy. Therefore the compliant member generally carries the electrical current through itself. This conductive material is machined or formed into a spring and is generally overplated with protective conductive coatings such as tin or gold.

Other compliant members of an electrical connection have been made of elastomeric (rubber-like) material which, when compressed, provides the sufficient normal force for the connection. As the material is initially non-conductive, it is made conductive by selectively impregnating it with conductive material, or by overlaying a sheet of film which carries conductive traces. Another configuration or elastomeric connectors uses metal strips wrapped around the elastomeric material. The elastomeric material is not directly overplated with the metallic conductive coatings used with metal springs since such conductive coatings would crack under the compression and extension to which elastomeric connectors would be subjected.

The different types of Input/Output connectors for printed circuit boards described above require many manufacturing operations to construct the elements and to assemble the elements into their various final configurations. Additional assembly costs are then required to attach these connectors to the printed circuit board.

The concept of constructing the printed circuit board through molding and selective plating is known. Rather than starting with a planar laminate of copper clad glass epoxy, the base of a molded circuit board is produced by molding. This molding process allows the structure to have various 3-dimensional features. In order to have these 3-dimensional features on conventional planar boards, these features would have to be separately manufactured (for example, bosses and brackets) and later attached or incorporated by secondary operations.

The molded structure is further processed by selectively applying a conductive surface to it. Such processes consists of roughening the surface by mechanical means such as sandblasting or abrasion, or chemical means which attack the surface of the molded structure to increase the adhesion of the conductive layer thereto. The surface is then selectively coated with one or more conductive layers through several manufacturing operations. The Molded Circuit Board may then have components attached which are electrically interconnected, most often by soldering, but otherwise by conductive adhesives.

The present invention relates to the molding of the circuit board, together with compliant springs and a rigid protective housing for these springs. This molding process just described can be accomplished in as little as one operating step. The compliant springs are shaped like cantilever beams attached to the molded circuit board and extending therefrom. These compliant springs act as an electrical Input/Output connector for the molded circuit board.

The use of plastics as spring members requires considerable caution as they do not respond to stress in the same way as metals. A primary difference between stressed polymers and metals is a greater relaxation of stress with time with polymers. Newer engineered polymers have been tested under stress and data has been generated which can predict the amount of stress relaxation that will occur over time. The predicted values will vary with different conditions of deflection and temperature. The predictability of this stress relaxation is a basis for this invention.

An element of this invention is a non-conductive compliant member made in the molding process in the shape of a cantilever beam. The beam is then directly overplated with conductive materials like copper, nickel, tin or gold. These springs are quite small, being designed to mate with other conventional connector interfaces. It is essential that such small members be physically protected to prevent breakage due to deflection beyond the design limits. Such deflections can be in directions other than those intended or in the intended direction to an amount greater than that for which it was designed. Such deflections can be limited by a protective barrier or housing. Further, the conductive surface on the beam must be restricted from excessive flexing to prevent fracture or cracking of the thin plating on the surface. The protective restriction could be accomplished by placing a protective barrier or housing in close proximity to the spring if such a barrier could be positioned very accurately.

A further essential element of this invention is an accurately positioned rigid protective barrier or housing which is manufactured of non-conductive material positioned in close proximity to the spring. In order to very accurately position the barrier in relation to the springs, the barrier is aligned on those springs during the manufacturing process. The protective barrier or housing is produced by the same method of manufacture as the spring, by molding. A preferred method is to mold the housing of the same material, in the same mold, and at the same time as the spring. It may also be accomplished by molding in a second molding operation of a similar non-conductive material. In this instance, the housing still must be carefully and specifically positioned in reference to the springs in the second mold tool, or the other mold tool cavity in the same mold. This careful positioning is nevertheless accomplished because the housing is produced by the same process as the springs although in a different step.

SUMMARY OF THE INVENTION

The present invention relates to an electrical connector receptacle for printed circuit boards having circuitry patterns formed thereon with a plurality of receiving openings in a block pattern. More particularly, this invention relates to a receiving connector receptacle having a grounding or conductive surface which is metallized by a surface treatment so as to render the surface conductive. Each receiving connector receptacle has a compliant spring of thermoplastic molded simultaneously with the connector receptacle. Around each compliant spring member is a molded protective housing. Said protective housing limits the deflection of the spring member when a connecting post or header pin is inserted. The protective housing and compliant spring may be molded to a circuit board as an integral part thereof.

It is therefore an object of this invention to provide a compliant spring conductive contact which reliably mates with a corresponding mating contact at a conductive metal-to-metal contact.

It is a further object of this invention to provide a receptacle connector for mating two electrically conductive contact members, one of said conductive contact members being a part of a receptacle or bore-like member having molded therein integral with the receptacle housing conductive compliant spring contacts for engaging the other conductive contact member—an inserting or finger-like member.

As an object of this invention, it is intended to provide that the outer housing of each receptacle or bore-like member performs as a physical barrier to the deflection of the compliant spring upon insertion of the inserting member.

Another objective of this invention is the provision for a rigid protective barrier or housing of otherwise nonconductive material in close proximity to the compliant spring, at the same time, and by the same method of manufacture of the compliant spring, for the purpose of protecting the over deflection of the compliant spring beyond the design limit.

Yet another object of this invention is to provide a method of manufacture of a rigid protective barrier or housing around or in close proximity to the compliant spring in the same method as the manufacture of the spring, that is, the barrier or housing is molded of the same non-conductive material, in the same mold, and at the same time as the molding of the compliant spring. After the molding of the housing and spring, selective plating of the compliant spring makes it conductive and provides an electrical connection to the printed circuit board to which it is molded.

Alternatively, the housing or barrier may be molded in a second molding operation of a similar non-conductive material. This two step process will require careful positioning of the housing in relation to the compliant spring member in the second mold tool, or the other mold tool cavity in the same mold in which the housing and springs were aligned and manufactured by molding.

A better understanding of the invention, and additional advantages and objects of the invention, will become apparent to those skilled in the art by reference to the detailed description and the accompanying drawings.

DETAILED DESCRIPTION OF THE INVENTION

Figure 1:
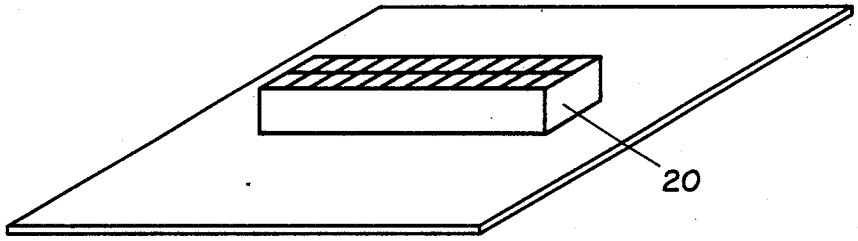
FIG. 1 is a perspective view of a receptacle connector with compliant springs in position on a printed circuit board.

In one embodiment of the invention the electrical conductor contacts as seen in FIGS. 1, 2, 3 and 4. The receptacle includes a generally rectangular or cylindrical housing-barrier which also acts as a restrictor or physical barrier. The receptacle connector is adapted to house and accept typical finger or pin-like mating connector components. The individual receptacle connector has a housing-barrier 21 which is spatially positioned about interiorly positioned parallel compliant spring beams 1 and 2. Parallel compliant spring beams 1 and 2 are opposed cantilevered beams which each terminate on the inner base of the housing-barrier. Said compliant springs are arranged with flexible connecting ends on their respective free end with a shaped curve to more easily facilitate and guide insertion of a connecting pin 91 into the space 24 between the opposed cantilevered sides. The space between the compliant springs is slightly less in transverse cross-section than the inserting member, so that the fit of the two parts is of sufficient force to achieve a firm contact of the conductive surfaces thereon.

Contact portions 8 and 9 of beams 1 and 2 are thinly plated with a metal having excellent conducting characteristics, such as gold, and are arranged to accept and mate with a mating contact element 91, such as a card edge tongue. The contact portion 8 and 9 are spatially positioned apart and opposite each other on the inside face of beams 1 and 2, respectively. Preferably for a given intended use the spatial separation of the opposed faces 8 and 9 is slightly less than the effective width of the mating contact element 91. Said spatial separation is sufficient to cause a flexing of the beams 1 and 2. This is followed by a relaxation which holds the mating contact element firmly in place between the contacting faces 8 and 9.

Figure 2:
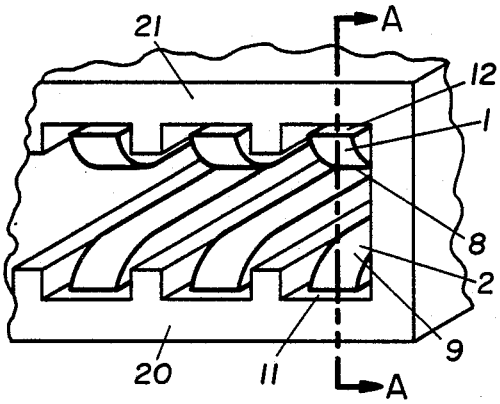
FIG. 2 is a close-up, detailed view of the housing of the receptacle connector wherein the cantilevered beams are non-stressed prior to insertion of the connecting member.
Figure 3:
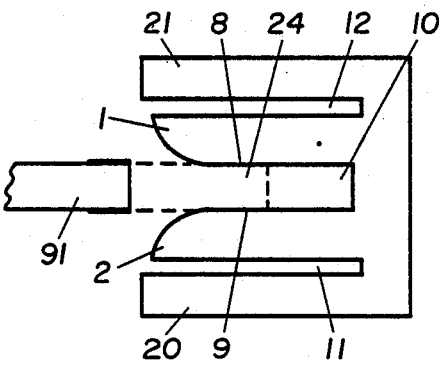
FIG. 3 is a side view along plane A—A of FIG. 2 showing the interior arrangement of a single compliant spring and its corresponding protective housing-barrier.

In FIGS. 2 and 3 the direction of the mating element for insertion is parallel to the beams 1 and 2. Whereas in FIG. 4 the direction of insertion or contact with the conductive surfaces 61 and 62 can be either parallel to the curved beams 53 and 54 into the space 42 separating the beams. Alternatively, the direction of insertion can be perpendicular to the curved beams 53 and 54. By horizontal insertion of a wire, pin or the like into the space 42 separating beams 53 and 54. Deflection of the beams is permitted and is limited only by the housing-barrier 51 and 52.

Figure 4:
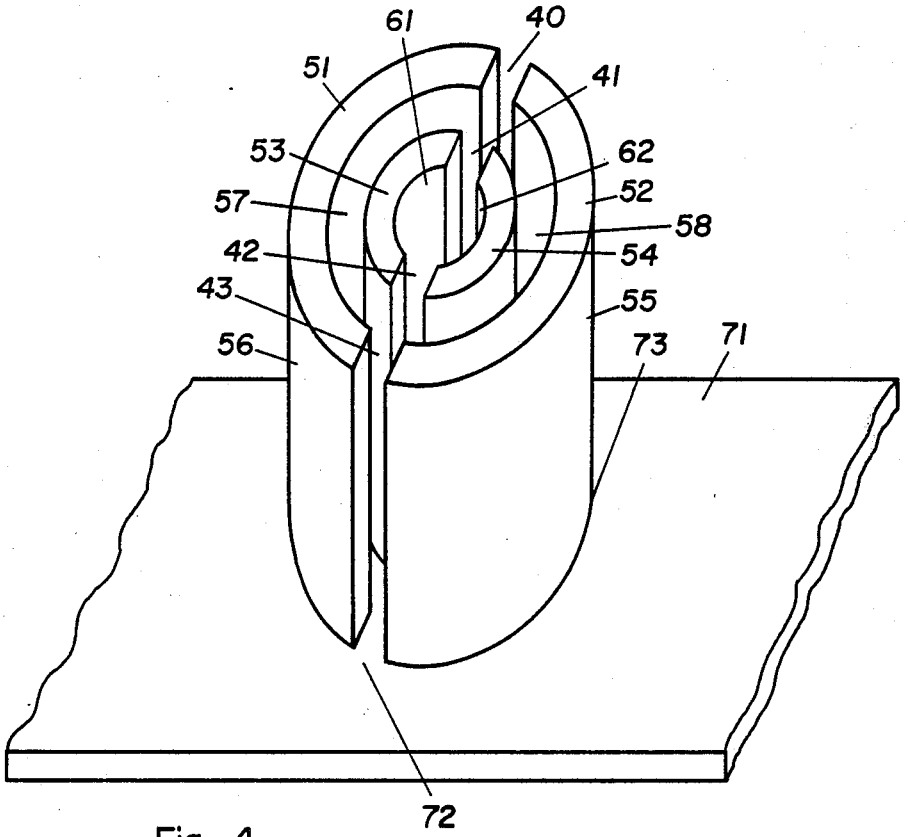
FIG. 4 is a perspective close-up, detailed view of another preferred configuration of a stand-alone compliant spring compliant member showing the interior arrangement with the spatial relationship of the compliant spring to the barrier.

The contact portions 8 and 9 in FIGS. 2 and 3 or 61 and 62 in FIG. 4 are preferably configured with the housing-barrier so as to be positioned parallel to the wall of the housing-barrier and interior thereto. The housing-barrier is separated from the compliant springs by a relatively small distance. The housing-barrier acts to stop the excessive flexing or horizontal displacement of the compliant spring beams 1 and 2 or 53 and 54 when the mating element is inserted therebetween.

An essential element of this invention is a rigid protective housing-barrier which is manufactured of non-conductive material in close proximity to the compliant spring, both manufactured by the same method. When the horizontal displacement of the compliant springs is expected to cause contact of the back surface of the respective compliant spring beams and the rigid housing-barrier, the entire compliant spring beams, or selectively the interior opposed surfaces thereof, are metallized with a conductive material and the barrier-housing is not metallized. As an alternative, if the rigid housing-barrier is conductive and if the housing contains multiple contacts which have different electrical potential, then those sections of the housing must be selectively isolated by an appropriate process of selective plating of the housing which leaves a non-conductive barrier or area between housing-barrier contact areas. This system of selectively metallizing portions of the housing-barrier is necessary to prevent shorting of the contacts.

FIG. 4 represents another preferred embodiment wherein the housing-barrier 55 and 56 is substantially circular configuration with interior concentric cantilevered beams 53 and 54 with a longitudinal separation therebetween so as to separate the housing-barrier into two parts 55 and 56 and the cooperating parallel elongated groves 41 and 42 separating the compliant spring beams 53 and 54 permit the transverse insertion of a conducting element, such as a pin or wire. The inner surfaces 61 and 62 of beams 53 and 54 are metallized to be conductive. The metallized surfaces 61 and 62 contact a conductive strip 72 on board 71.

Therefore, the present invention is an electrical connector for interconnecting a mating modular unit having a grounding insert, said electrical connector includes a housing or connector shell of molded polymer which is metallized by a surface treatment so as to render the entire common contact surface conductive between the interconnecting mating members. The interconnecting mating members consist of an inserting or finger-like member which is also conductive and a corresponding receiving or bore-like member formed in the connector shell. The receiving member having an inner configuration which enables the inserting member to sufficiently and firmly contact the conductive surface thereon. The receiving or bore-like member having at least one molded compliant spring member capable of limited flexion within the connector shell or housing. In the preferred embodiment, the receiving or bore-like member has a pair of opposed compliant spring members capable of limited flexion within the connector shell or housing. Therefore the instant invention provides for compliant springs shaped like cantilever beams and acting as the electrical connector for mating with a corresponding inserting or finger-like member.

The compliant member is made of non-conductive material which is formed into a spring by the molding process. In order to become conductive in the connective areas corresponding to the insert member the compliant member is overplated selectively with a conductive material, such as copper, nickel, tin, gold or silver.

The compliant springs are small, yet designed to mate securely with other conventional connector interfaces which are inserted into the compliant spring containing bore or housing. It is essential that such small compliant spring members be physically protected from excessive flexion when the insert is mated therein to prevent fracture, cracking or other breakage of the thin conductive plating thereon or the base of the compliant spring itself. Since the compliant spring is similar to a cantilever beam, care must be taken to prevent the beam from deflections beyond the design limits or in directions other than those intended in the design. Such deflections are limited by rigid protective barriers or housings.

Hence, the restriction from excessive flexing and deflection from the intended direction is accomplished by positioning a rigid protective barrier or housing in close proximity to the flexible compliant springs. This can be accomplished by accurately positioning such a barrier or housing around the flexible compliant spring, close to but spatially apart from the compliant spring.

It has been found that in order to very accurately position the barrier or housing in close spatial relationship to the compliant springs, alignment should be achieved by manufacturing the barrier-housing in a position in direct relationship to the position of the spring. Preferably, the housing or barrier and the compliant springs are aligned and manufactured by the same process and at the same time. A preferred method of manufacture is to mold the housing or barrier of the same material, in the same mold, and at the same time as the molding operation for the compliant springs. Manufacture also may be carried out by molding the housing or barrier in a second molding operation after the molding of the compliant springs and of a similar non-conductive material. Similarly, in this instance, the housing or barrier will require careful and specific positioning in relative relationship to the compliant springs in a second mold tool, or another mold tool cavity in the same mold. The result must be a carefully aligned housing or barrier in close spatial relationship to the compliant springs which are positioned interior of the housing or barrier.

The compliant springs by definition are resilient. The resiliency of the individual compliant spring provides a resistive insertion force for the mating insert conductor. When used in pairs, the mating conductor has a transverse cross-section greater than the distance between the individual compliant spring and the restricted distance of deflection. The distance of deflection of each compliant spring is restricted or limited by the spatial configuration relative to the distance between the compliant spring and the housing-barrier. When a single compliant spring is used the mating conductor may have a transverse cross-section greater than the distance between the individual compliant spring and the fixed or stationary opposing surface, but less than the distance between the individual compliant spring and the fixed or stationary opposing surface and the restricted distance of deflection. The distance of deflection of the compliant spring again is limited by the spatial configuration of the compliant spring to the housing-barrier. The mating insert is compressibly received within the opening in the space between the compliant springs located within the housing-barrier. The force of the compression aids to form a conductive electrical surface between the compliant spring interior facing and the insert mating conductor.

The individual compliant spring is contemplated as being constructed of a non-conductive molded plastic which may be selectively coated on the interior contact surface, as by vapor deposition, sputtering, photo-negative or photo-positive masking, electrochemical plating and the like. Such a prepared compliant spring of resilient moldable thermoplastic is capable of electrical connection to a conductive insert. High temperature thermoplastics, such as polyethersulfone, have been found to possess favorable suitable characteristics for metallized plating by various methods. For example, a chemical adhesion process and photo-masking or by a semi-additive process with electrolytic deposition of conductive metals. This thermoplastic, as well as being metallizable, provides the necessary spring force to be successfully employed in the present invention.

Accordingly, it can be seen that the construction of an improved electrical connector employing resilient thermoplastic compliant springs and receiving a conductive insert according to the present invention is described herein. At the same time, a highly reliable and stable electrical connection is made by virtue of the construction of the compliant spring and housing or barrier configuration in close spatial relationship to each other and in a single one piece integral construction.

Many variations of the invention described hereinabove are possible. Use of such variances as angles, plating materials, materials of construction heretofore unknown but having desirable creep and stress properties and/or other plastics having the required suitable characteristics are considered to be within the scope of the claims.

What is claimed is:

1. An electrical connector for connecting separable electrically conductive members comprising:

a rigid housing-barrier having at least one receptacle opening;

said receptacle opening having interior thereto at least one electrically conductive cantilevered compliant spring member for engaging with an electrically conductive complementary mating member;

said compliant spring being molded as an integral interior part of said housing-barrier and being closely spatially disposed away from said housing-barrier interior.

2. The electrical connector of claim 1, wherein the compliant spring is resiliently cantilevered at one end, and spaced therein so as to be physically restricted upon deflection by contact with the housing-barrier.

3. The electrical connector of claim 1, wherein a pair of parallel compliant springs are interiorly disposed within the receptacle opening of the housing-barrier and spatially disposed therein to accept a mating electrically conductive member by insertion therebetween and spatially disposed therein to be physically restricted upon deflection by contact with the housing-barrier.

4. The electrical connector of claim 3, wherein the paired compliant springs are spaced apart a distance somewhat less than the transverse cross-section of the mating member and the distance of deflection of said compliant springs is limited to a non-destructive distance by engagement thereof with the rigid housing-barrier.

5. The electrical connector of claims 1 or 3 wherein the housing-barrier and the compliant spring members are molded as a continuous integral part of the same thermoplastic material.

6. The electrical connector of claims 1 or 3 wherein the housing-barrier and the compliant spring members are molded as an integrated unit by a two-step molding process.

7. The electrical connector of claim 6 wherein the housing-barrier and the compliant spring members are molded of similar thermoplastic material in a two-step molding process.

8. The electrical connector of claim 1 wherein the compliant spring is metallized to be conductive, while the housing-barrier is maintained non-conductive.

9. A multiple-position electrical receptacle connector comprising a rigid housing-barrier having openings for receiving a conductive mating insertion member, wherein with said openings at least one metallized cantilevered compliant spring is spatially disposed and arranged to accept and engagingly cooperate with said insertion member, said compliant spring to be an integral part of said housing-barrier being manufactured of similar material at the same time by molding, said compliant spring is resiliently flexible to apply force on the insertion member to achieve a conductive interface therebetween, the flexing of the compliant spring is limited by the close spatial disposition of the compliant spring to the housing-barrier.

10. The electrical receptacle connector of claim 7, wherein the housing-barrier and the compliant springs are molded from the same thermoplastic material and the compliant springs are an integral part of said housing-barrier.

11. The electrical receptacle connector of claims 2, 4, 8 or 9, wherein the connector is an integral part of a printed circuit board.

12. The electrical receptacle connector of claim 11 wherein the compliant springs are metallized and connected to a conductive strip on said printed circuit board.

13. The electrical receptacle connector of claims 1, 2, 3, 4, 8 or 9, wherein the compliant spring has the housing-barrier to strike against as a limiting barrier when the mating member is inserted.

* * * * *